US007159749B2

(12) United States Patent
Tsai

(10) Patent No.: US 7,159,749 B2
(45) Date of Patent: Jan. 9, 2007

(54) STAPLER CAPABLE OF CUTTING STAPLE LEGS

(75) Inventor: Eric Tsai, Tali (TW)

(73) Assignee: Apex Mfg. Co., Ltd., Tali (TW)

( * ) Notice: Subject to any disclaimer, the term of this patent is extended or adjusted under 35 U.S.C. 154(b) by 0 days.

(21) Appl. No.: 10/908,888

(22) Filed: May 31, 2005

(65) Prior Publication Data

US 2006/0266789 A1 Nov. 30, 2006

(51) Int. Cl.
*B25C 7/00* (2006.01)

(52) U.S. Cl. ..... 227/155; 227/156; 227/79

(58) Field of Classification Search ..... 227/155, 227/156, 79
See application file for complete search history.

(56) References Cited

U.S. PATENT DOCUMENTS

| | | | | |
|---|---|---|---|---|
| 1,962,874 | A | 6/1934 | Polzer | |
| 2,083,227 | A | 6/1937 | Drypolcher | 227/76 |
| 3,034,382 | A | 5/1962 | Herbert | 29/566 |
| 4,199,095 | A | 4/1980 | Yamanoi | 227/125 |
| 4,378,085 | A | 3/1983 | McVeigh | 227/79 |
| 4,449,661 | A | 5/1984 | Spehrley, Jr. | 227/155 |
| 4,593,847 | A | 6/1986 | Hagemann | 227/155 |
| 4,664,305 | A | 5/1987 | Blake et al. | 227/19 |
| 4,844,319 | A | 7/1989 | Kurosawa | 227/79 |
| 5,029,745 | A | 7/1991 | Akizawa et al. | 227/155 |
| 5,413,266 | A | 5/1995 | Jairam | 227/129 |
| 5,516,025 | A | 5/1996 | Eriksson | 227/155 |
| 5,586,710 | A | 12/1996 | Golicz | 227/155 |
| 5,639,007 | A | 6/1997 | Nakamura | 227/109 |
| 5,645,567 | A | 7/1997 | Crainich | 606/219 |
| 5,758,813 | A | 6/1998 | Kikuchi et al. | 227/155 |
| 5,791,543 | A | 8/1998 | Udagawa et al. | 227/4 |
| 6,036,074 | A | 3/2000 | Manabe | 227/155 |

(Continued)

FOREIGN PATENT DOCUMENTS

DE 44 34 513 C1 8/1995

OTHER PUBLICATIONS

PCT Patent Publication No. WO 03/057417 A1, Jul. 17, 2003, 24 pages.

*Primary Examiner*—John Sipos
*Assistant Examiner*—Michelle Lopez
(74) *Attorney, Agent, or Firm*—Alan D. Kamrath; Nikolai & Mersereau, P.A.

(57) ABSTRACT

A stapler includes a base, a cover put movably on the base, a feeding device for feeding staples, and a bending and cutting device provided between the base and the cover for bending and cutting the legs of each staple. The cutting device includes a seat provided on the base and a housing attached to the cover. The seat includes two wedges formed thereon and a pusher formed thereon. A stationary cutting element is provided in the housing. Two movable cutting elements are provided movably in the housing and on the two wedges so that they are moved towards the stationary cutting element in order to cut the legs of each staple as they are moved towards the seat together with the housing. A spring is put between the movable cutting elements in a tendency to push the movable cutting elements from the stationary cutting element. Two bending elements are provided movably and pivotally in the housing above the movable cutting elements so that they are pushed by the pusher in order to bend the legs of each staple after the stationary cutting element and the movable cutting elements cut the legs of each staple.

19 Claims, 8 Drawing Sheets

U.S. PATENT DOCUMENTS 6,056,183 A * 5/2000 Tanabe ..... 227/155
6,250,531 B1 6/2001 Yagi ..... 227/79
6,637,635 B1 * 10/2003 Borjesson et al. ..... 227/155
6,698,640 B1 3/2004 Hakozaki et al. ..... 227/4
6,776,321 B1 8/2004 Jairam et al. ..... 227/134
6,820,790 B1 11/2004 Ura ..... 227/131
6,935,547 B1 8/2005 Mochizuki ..... 227/131
6,942,136 B1 * 9/2005 Tsai ..... 227/155
6,981,626 B1 1/2006 Tsai ..... 227/79
6,981,627 B1 1/2006 Tsai ..... 227/155
7,021,515 B1 4/2006 Elonsson et al. ..... 227/134
2003/0111506 A1 6/2003 Kanai et al. ..... 227/131
2006/0118593 A1 6/2006 Tsai ..... 227/76

* cited by examiner

STAPLER CAPABLE OF CUTTING STAPLE LEGS

BACKGROUND OF INVENTION

1. Field of Invention

The present invention relates to a stapler and, more particularly, to a stapler capable of cutting staple legs.

2. Background of Invention

WO 03/057417 A1 discloses a STAPLER WITH BENDING ARMS WHICH CUT THE STAPLER LEGS AGAINST A PAD. The stapler includes two bending arms 40 and 41 and a cutter 49. The bending arm 40 is pivotally provided by a pin 42. The bending arm 40 includes a lever 45 on a side of the pin 42 and a bending surface 44 on the other side of the pin 42. The bending arm 41 is pivotally provided by a pin 43. The bending arm 41 includes a lever 48 on a side of the pin 43 and a bending surface 47 on the other side of the pin 43. The cutter 49 includes two cutting edges 50 and 51. The cutter 49 is located between the bending surfaces 44 and 47. As the levers 45 and 48 are pivoted, the bending surfaces 44 and 47 bend and press stapler legs 53 and 54 against the cutting edges 50 and 51. Thus, the staple legs 53 and 54 are bent and cut. Several problems have been encountered in using this conventional stapler. The cutting edges 50 and 51 must be precisely located in the arched tracks of the travel of the ends of the bending surfaces 44 and 47 so that the shearing of the stapler legs 53 and 54 can occur between the cutting edges 50 and 51 and the bending surfaces 44 and 47. However, such precise location requires precise fabrication and assembly and inevitably incurs a high cost. Moreover, even if the bending arms 40 and 41 and the cutter 49 are precisely fabricated and assembled at the beginning, the gaps between them will eventually become too large for adequate operation as they wear out after time of service. In that case, a user will have to use a lot of energy and spend a long time to staple a stack of paper with a staple.

The present invention is therefore intended to obviate or at least alleviate the problems encountered in the prior art.

SUMMARY OF INVENTION

According to the present invention, a stapler includes a base, a cover put movably on the base, a feeding device for feeding staples, and a bending and cutting device provided between the base and the cover for bending and cutting the legs of each staple. The cutting device includes a seat provided on the base and a housing attached to the cover. The seat includes two wedges formed thereon and a pusher formed thereon. A stationary cutting element is provided in the housing. Two movable cutting elements are provided movably in the housing and on the two wedges so that the movable cutting elements are moved towards the stationary cutting element in order to cut the legs of each staple as the movable cutting elements are moved towards the seat together with the housing. A spring is put between the movable cutting elements in a tendency to push the movable cutting elements away from the stationary cutting element. Two bending elements are provided movably and pivotally in the housing above the movable cutting elements so that bending elements are pushed by the pusher in order to bend the legs of each staple after the stationary cutting element and the movable cutting elements cut the legs of each staple.

The primary advantage of the stapler according to the present invention is its low costs because it does not require high precision in assembly due to the movable cutting elements moved, instead of pivoted, towards the stationary cutting element.

Other objects, advantages and novel features of the invention will become more apparent from the following detailed description in conjunction with the attached drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
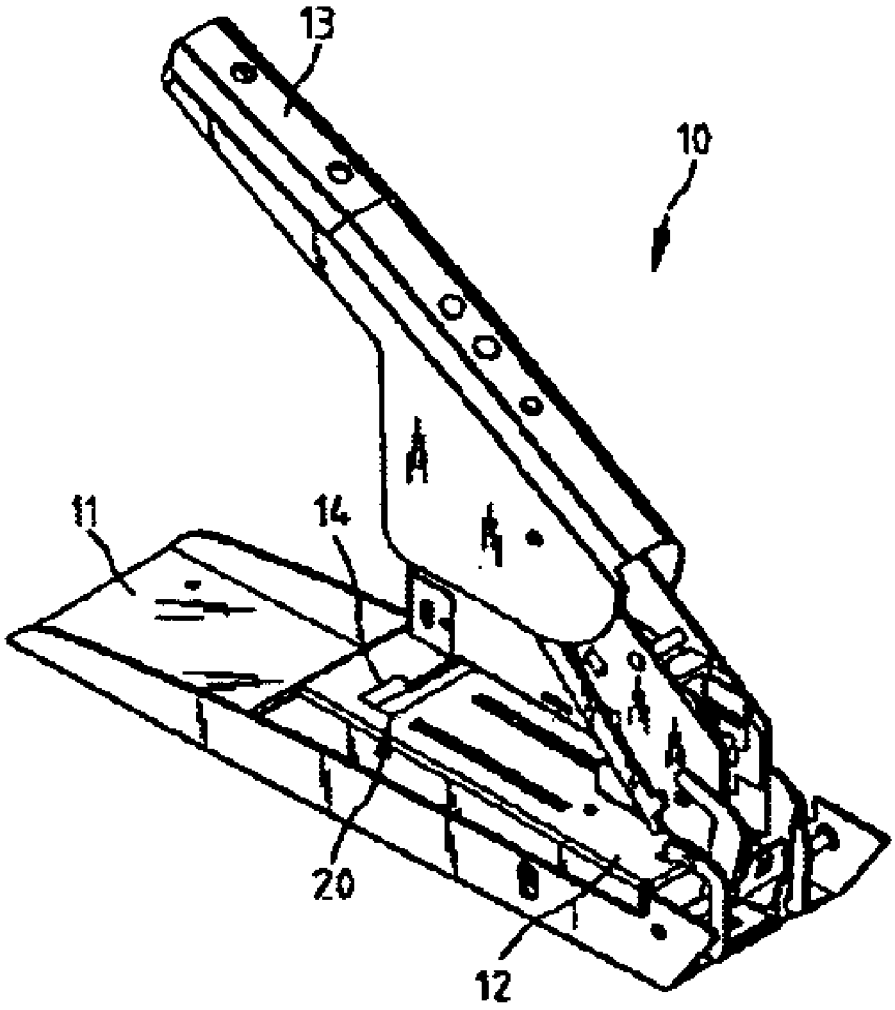
FIG. 1 is a perspective view of a stapler with a bending and cutting device according to the preferred embodiment of the present invention.
Figure 2:
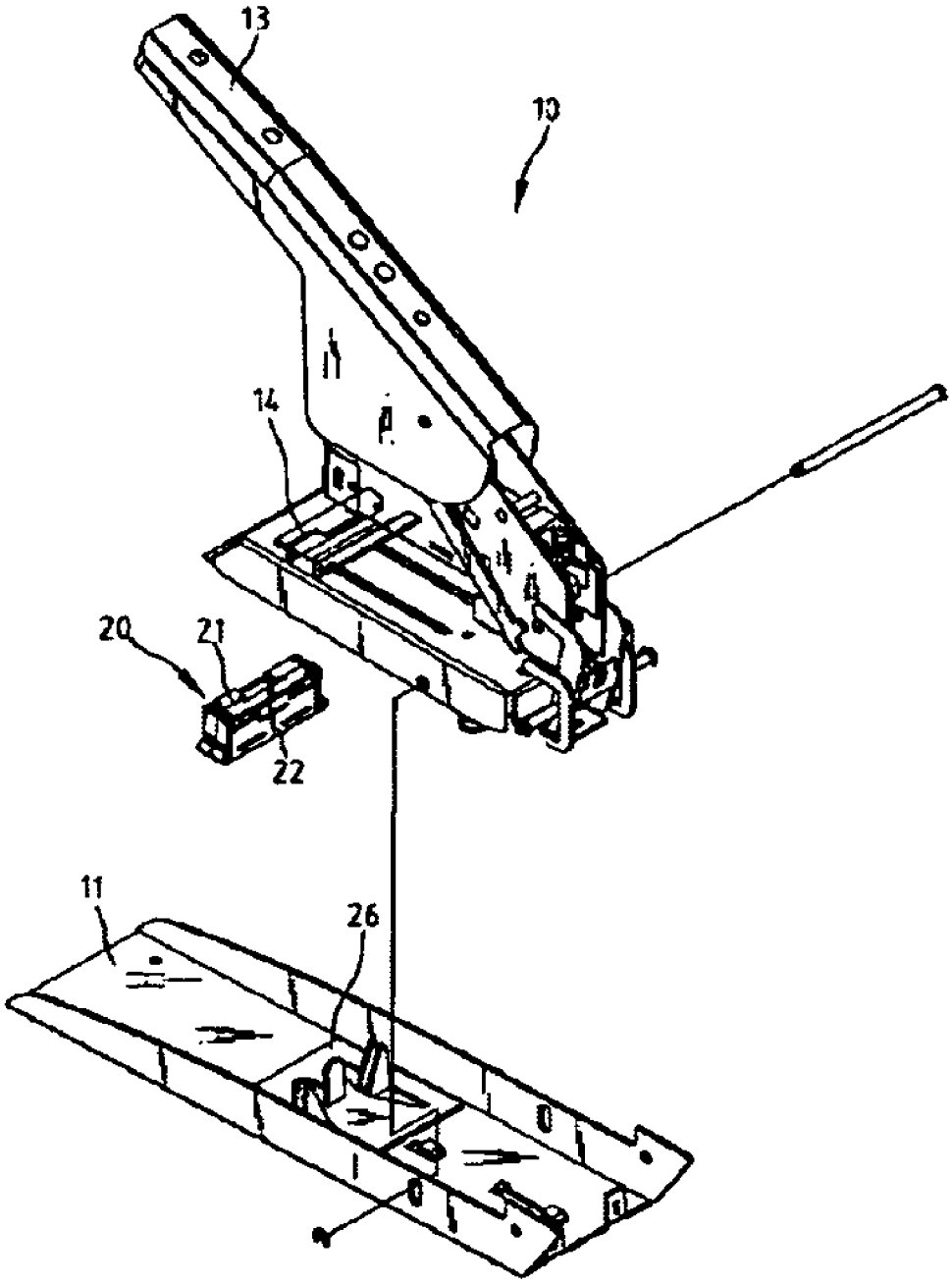
FIG. 2 is an exploded view of the stapler shown in FIG. 1.

Referring to FIGS. 1 and 2, according to the preferred embodiment of the present invention, a stapler 10 includes a base 11, a cover 12 provided on the base 11, a feeding device for feeding staples 30 each including two legs 31 (FIG. 5), a connecting device for connecting the base 11, the cover 12 and the feeding device with one another, and a bending and cutting device 20 for bending and cutting the legs 31. The base 11, the cover 12, the feeding device and the connecting device, and their interconnection are substantially conventional and will not be described in detail. The feeding device includes a cartridge 14 for storing the staples 30 and a lever 13 for moving the cartridge 14, driving the staples 30 from the cartridge 14 and moving the cover 12.

Figure 3:
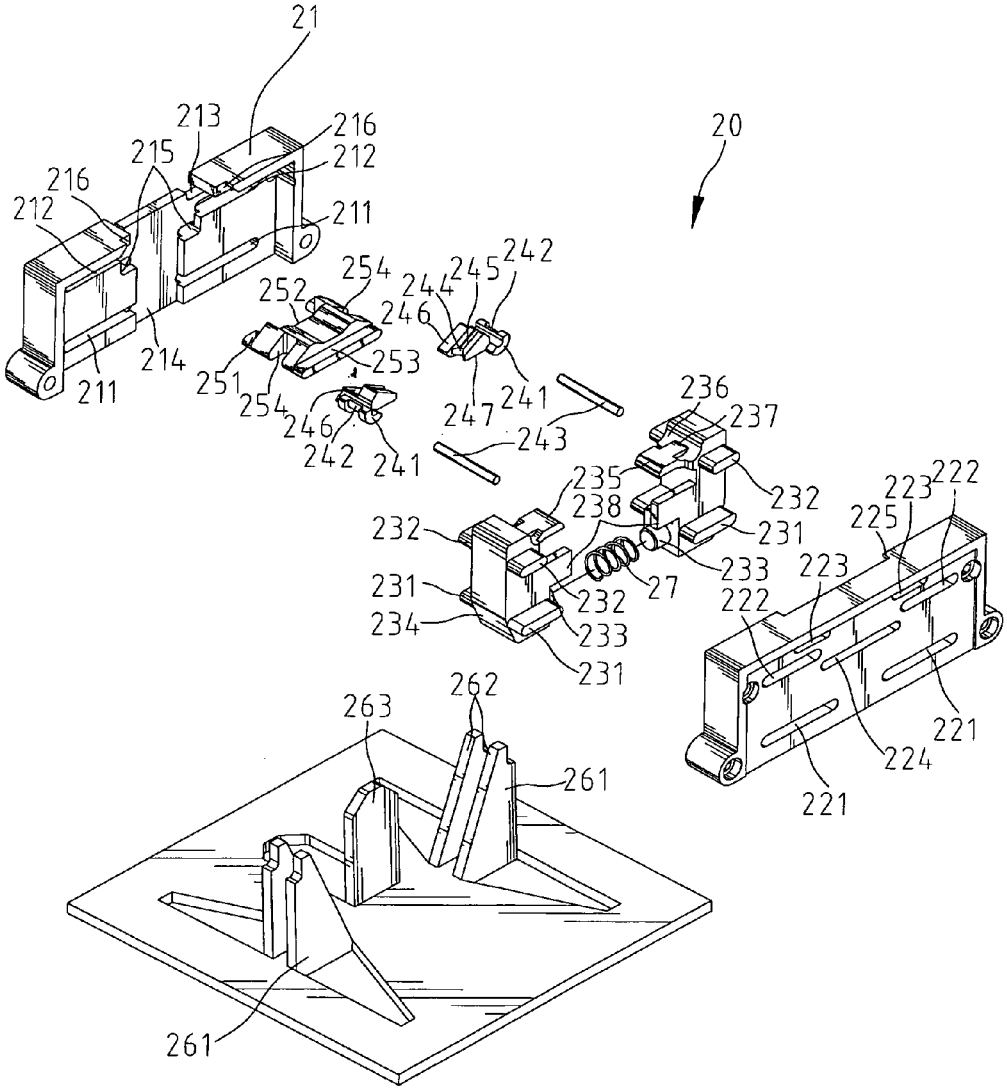
FIG. 3 is an enlarged exploded view of the bending and cutting device used in the stapler shown in FIG. 2.
Figure 4:
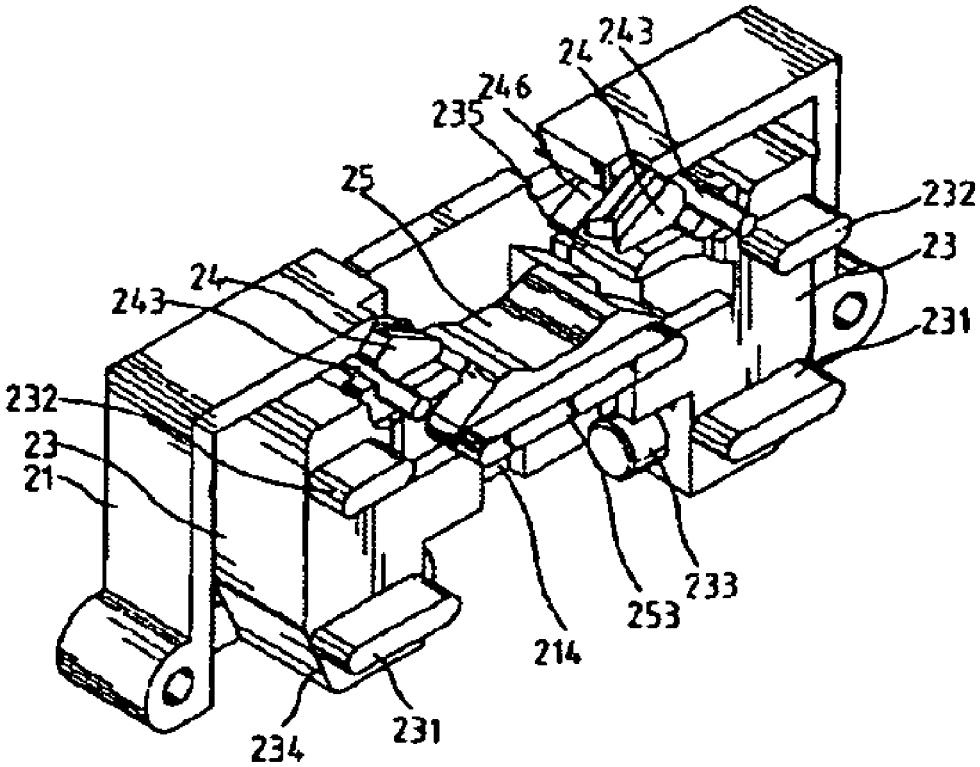
FIG. 4 is an enlarged perspective view of the bending and cutting device shown in FIG. 2.
Figure 5:
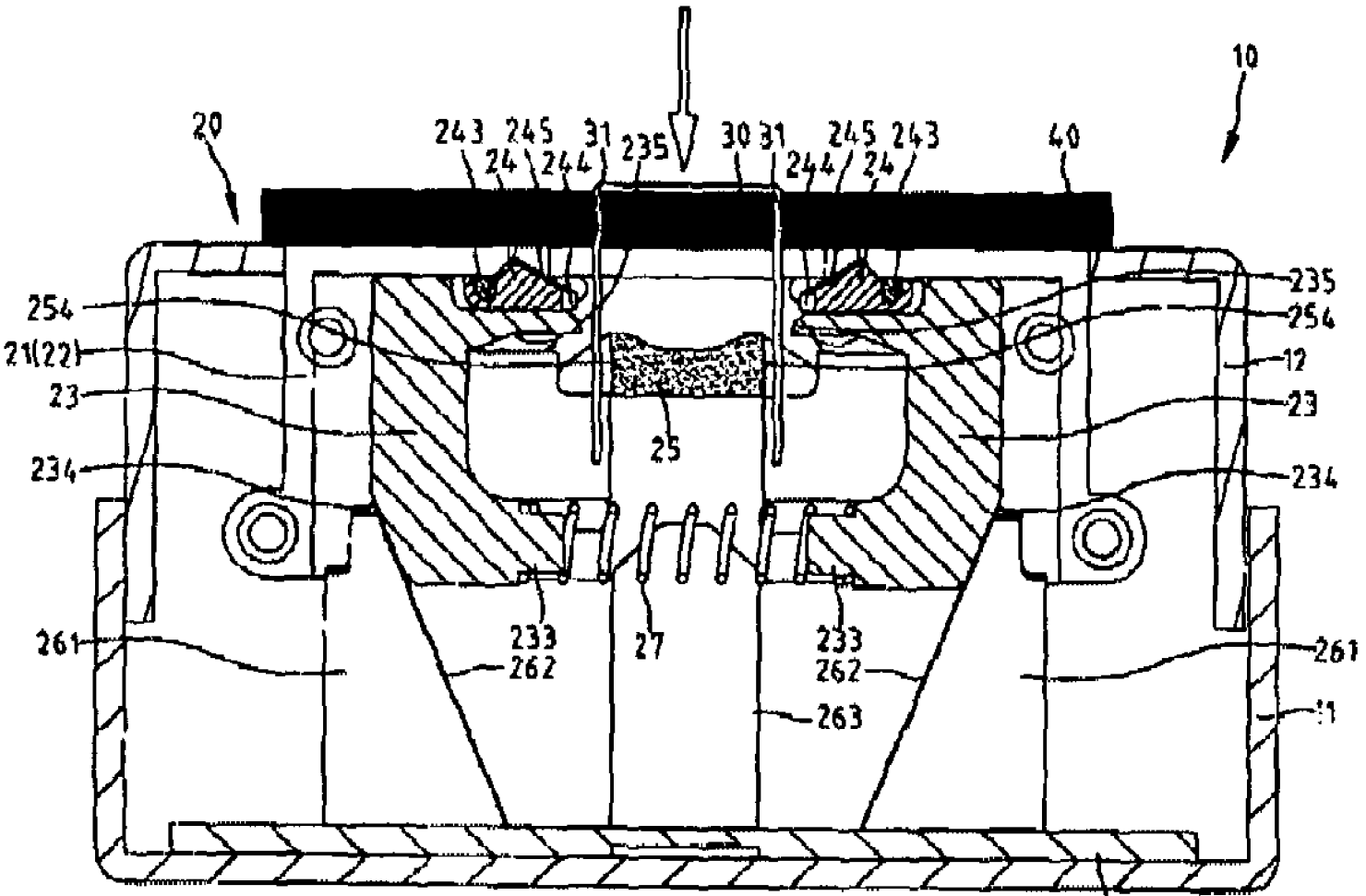
FIG. 5 is a cross-sectional view of the bending and cutting device shown in FIG. 1.

Referring to FIGS. 3 through 5, the bending and cutting device 20 includes a first shell 21, a second shell 22, two movable cutting elements 23, a spring 27, two bending elements 24, a stationary cutting element 25, and a seat 26.

The first shell 21 includes a wall (not numbered) and a ceiling (not numbered) formed on the wall. Two slots 211 are defined in the wall of the first shell 21. In the wall of the first shell 21 are defined two slots 212 parallel to the slots 211. In the wall of the first shell 21 are defined two slots 213 parallel to the slots 212. In the wall of the first shell 21 is defined a recess 214 between the slots 212 and between the slots 211. In the wall of the first shell 21 are defined two recesses 215 on opposite sides of the recess 214. In the ceiling of the first shell 21 are defined two recesses 216 for receiving the legs 31.

The second shell 22 includes a wall (not numbered) and a ceiling (not numbered) formed on the wall. In the wall of the second shell 22 are defined two slots 221 corresponding to the slots 211. In the wall of the second shell 22 are defined two slots 222 parallel to the slots 221. The slots 222 are located corresponding to the slots 212. In the wall of the second shell 22 are defined two slots 223 parallel to the slots 222. The slots 223 are located corresponding to the slots 213. In the wall of the second shell 22 is defined a slot 224 corresponding to the recesses 215. In the ceiling of the second shell 22 is defined a slot 225 corresponding to the recesses 216.

Each movable cutting element 23 includes a first side, a second side opposite to the first side, a third side towards the third side of the other movable cutting element 23, and a fourth side opposite to the third side. Each movable cutting element 23 includes slides 231 and 232 on the first side, slides 231 and 232 on the second side, a stem 233 on the third side, a beam 238 on the third side above the stem 233, a shank 237 on the third side above the beam 238, a blade 235 on the shank 237, a recess 236 in the third side, and a slope 234 on the fourth side.

The movable cutting elements 23 are provided between the first shell 21 and the second shell 22. The slide 231 on the first side of each movable cutting element 23 is put in a slot 211. The slide 232 on the first side of each movable cutting element 23 is put in a slot 212. The slide 231 on the second side of each movable cutting element 23 is put in a slot 221. The slide 232 on the second side of each movable cutting element 23 is put in a slot 222.

The spring 27 is put between the movable cutting elements 23. The stem 233 of each movable cutting element 23 is fit in an end of the spring 27. The spring 27 tends to keep the movable cutting elements 23 from each other.

Each bending element 24 includes a hub 241, a groove 242 in the external side of the hub 241, a first arm 247 extended from the hub 241, a recess 244 in the tip of the first arm 247, a groove 245 in an upper side of the first arm 247, and a second arm 246 extended from the hub 241. An angle exists between the first arm 247 and the second arm 246. The second arm 246 includes a smooth arched profile.

A shaft 243 is inserted in the hub 241 of each bending element 24. Each shaft 243 includes an end inserted in a slot 213 and an opposite end inserted in a slot 223. The ends of the shafts 243 can slide in the slots 213 and 223. The hub 241 of each bending element 24 is put on the recess 236 of a movable cutting element 23. The groove 242 of each bending element 24 receives the shank 237 of a movable cutting element 23. Thus, smooth pivotal movement of the bending elements 24 on the movable cutting elements 23 about the shafts 243 is ensured even when they are moved together.

The stationary cutting element 25 includes two blocks 251 on a side, a passage 252 between the blocks 251, a ridge 253 on an opposite side, and a cutting face 254 on each of two other sides.

The stationary cutting element 25 is provided between movable cutting elements 23. Each cutting face 254 cooperates with a blade 235 in order to form a pair of shears. The stationary cutting element 25 is provided on the beams 238. The blocks 251 are put in the recesses 215. The ridge 253 is put in the slot 224.

The seat 26 includes two pairs of wedges 261 thereon, a slope 262 on each of the wedges 261 and a pusher 263 thereon. The seat 26 is made of a metal plate, and each wedge 261 is punched from the metal plate. Each wedge 261 is thin and alone cannot provide adequate contact with a movable cutting element 23. Hence, for contact with each movable cutting element 23, a pair of wedges 261 is used. However, each pair of wedges 261 can be replaced with an adequately thick wedge attached to or cast on the seat 26. The pusher 263 includes two chamfers (not numbered) at the tip.

The first shell 21, the second shell 22, the movable cutting elements 23, the spring 27, the bending elements 24, and the stationary cutting element 25 are provided on the seat 26. The slope 234 of each movable cutting element 23 is in contact with the slopes 262 of a pair of wedges 261. The second arms 246 of the bending elements 24 are located above the pusher 263. The pusher 263 is put in the recess 214.

Referring to FIG. 5, the legs 31 of a staple 30 are punched into the bending and cutting device 20 through a stack of paper 40. Each leg 31 is located between a blade 235 and a cutting face 254.

Figure 6:
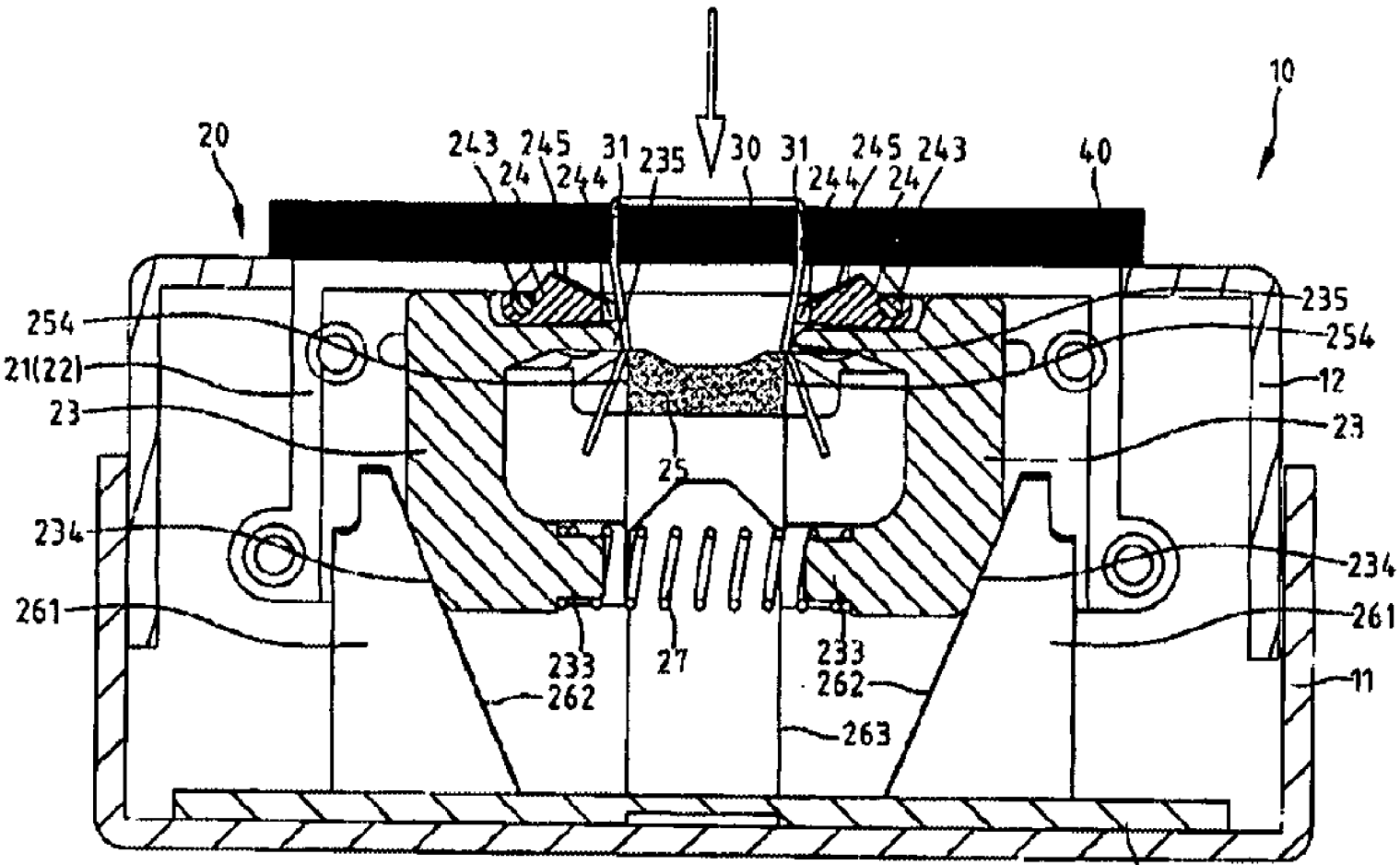
FIG. 6 is similar to FIG. 5 but shows the bending and cutting device cutting a staple.

Referring to FIG. 6, the cover 12 is pushed towards the base 11. The first shell 21, the second shell 22, the movable cutting elements 23, the bending elements 24, and the stationary cutting elements 25 are pushed towards the seat 26. The movable cutting elements 23 are pushed towards the stationary cutting element 25 as the slopes 234 are moved along the slopes 262. The blades 235 cooperate with the cutting faces 254 in order to shear the legs 31.

Figure 7:
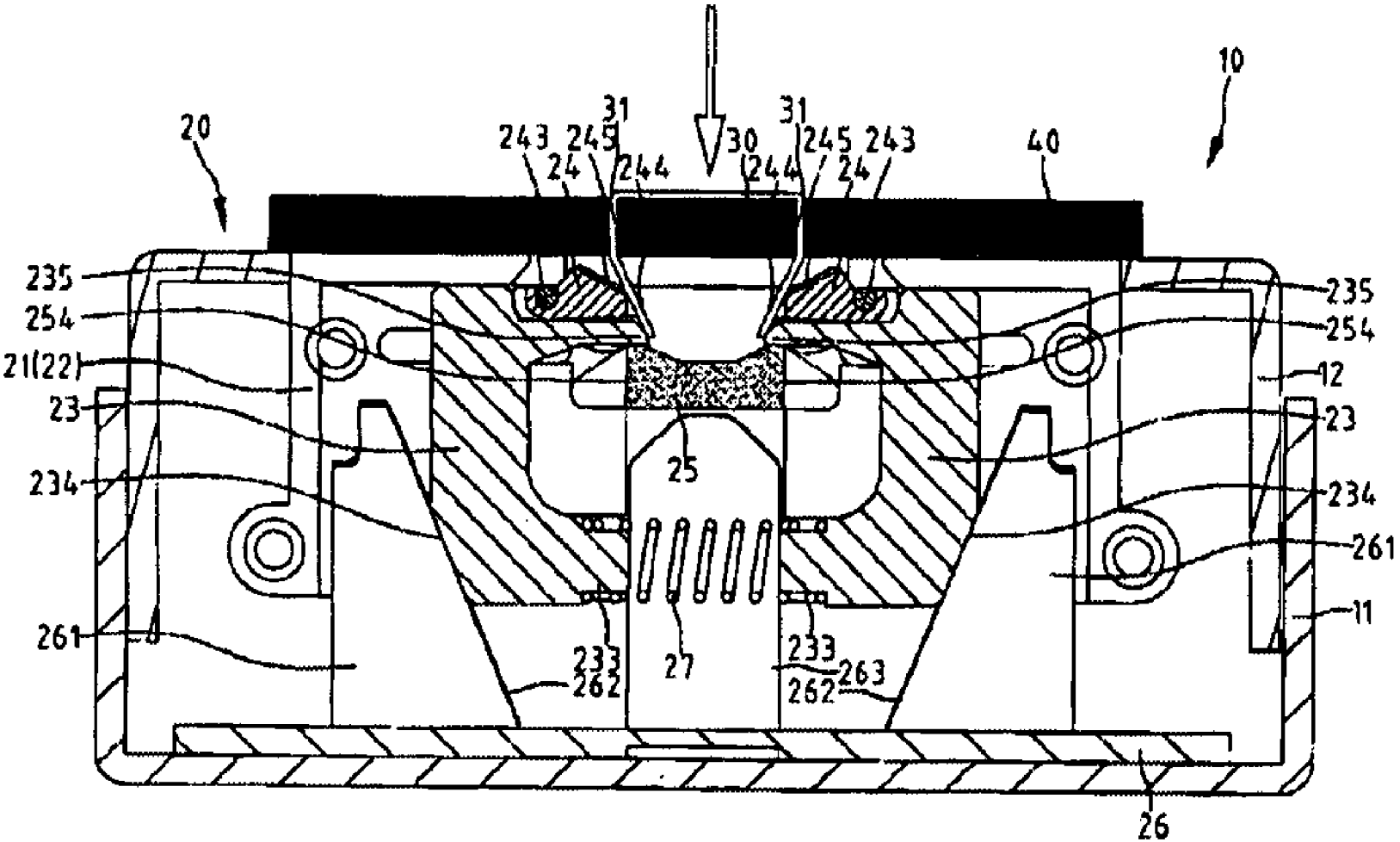
FIG. 7 is similar to FIG. 6 but shows the bending and cutting device bending the staple after cutting the same.

Referring to FIG. 7, the legs 31 have been cut. The legs 31 are bent by the blades 235. While bent by the blades 235, the legs 31 are kept in the recesses 244 so that undesired bias of the legs 31 is prevented.

Figure 8:
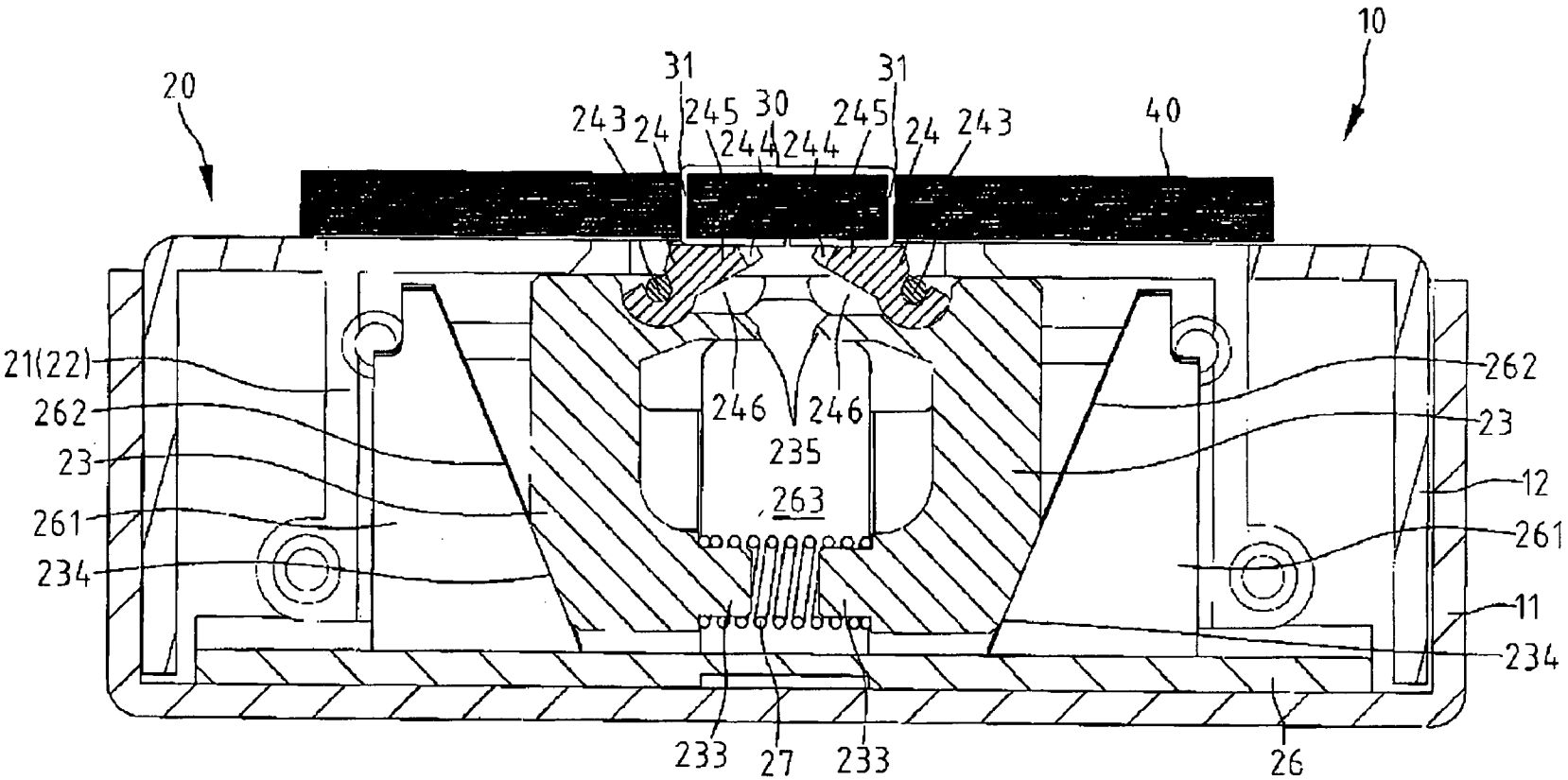
FIG. 8 is similar to FIG. 7 but shows the staple completely bent by the bending and cutting device.

Referring to FIG. 8, the second arms 246 are pivoted by the pusher 263. The sliding of the second arms 246 on the pusher 263 is ensured due to the matched, smooth arched profiles of the former and the chamfered end of the later. Accordingly, the first arms 247 are pivoted. Hence, the legs 31 are pushed by the first arms 247 until the former come into flush contact with the stack of paper 40. While bent by the first arms 247, the legs 31 are kept in the recesses 245 so that undesired bias of the legs 31 is prevented.

The stapler according to the present invention exhibits at least one advantage, i.e., its low cost, because it does not require high precision in assembly due to the movable cutting elements 23 moved, instead of pivoted, towards the stationary cutting element 25.

The present invention has been described through the detailed description of the preferred embodiment thereof. Those skilled in the art can derive variations from the preferred embodiment without departing from the scope of the present invention. Therefore, the preferred embodiment shall not limit the scope of the present invention defined in the claims.

What is claimed is:

1. A stapler comprising a base, a cover put movably on the base, a feeding device for feeding staples each having first and second legs, and a bending and cutting device provided between the base and the cover for bending and cutting the first and second legs of each staple, wherein the cutting device comprises:

a seat provided on the base, the seat comprising two wedges formed thereon and a pusher formed thereon;

a housing attached to the cover;

a stationary cutting element provided in the housing;

two movable cutting elements provided movably in the housing and on the two wedges so that the two movable cutting elements are moved towards the stationary cutting element in order to cut the first and second legs of each staple as the two movable cutting elements are moved towards the seat together with the housing;

a spring put between the movable cutting elements in a tendency to push the movable cutting elements away from the stationary cutting element; and two bending elements provided movably and pivotally in the housing above the movable cutting elements so that the two bending elements are pushed by the pusher in order to bend the first and second legs of each staple after the stationary cutting element and the movable cutting elements cut the first and second legs of each staple.

2. The stapler according to claim 1 wherein the cutting takes place in the form of shearing.

3. The stapler according to claim 1 wherein the stationary cutting element comprises two cutting faces, wherein each of the movable cutting elements comprises a blade for cooperation with one of the two cutting faces for shearing one of the first and second legs of each staple.

4. The stapler according to claim 1 wherein the housing comprises a first shell and a second shell attached to the first shell.

5. The stapler according to claim 4 wherein the stationary cutting element comprises two blocks formed thereon, wherein the first shell defines two recesses for receiving the two blocks.

6. The stapler according to claim 4 wherein the stationary cutting element comprises a ridge formed thereon, wherein the second shell defines a slot for receiving the ridge.

7. The stapler according to claim 4 wherein the first shell defines at least one pair of slots, wherein each of the two movable cutting elements comprises at least one slide for sliding in one of the slots.

8. The stapler according to claim 7 wherein the at least one pair of slots comprises a first pair of slots and a second pair of slots, wherein the at least one slide comprises a first slide for sliding in one of the first pair of slots and a second slide for sliding in one of the second pair of slots.

9. The stapler according to claim 4 wherein the second shell defines at least one pair of slots, wherein each of the two movable cutting elements comprises at least one slide for sliding in one of the pair of slots.

10. The stapler according to claim 9 wherein the at least one pair of slots comprises a first pair of slots and a second pair of slots, wherein the at least one slide comprises a first slide for sliding in one of the first pair of slots and a second slide for sliding in one of the second pair of slots.

11. The stapler according to claim 4 wherein each of the bending elements comprises a hub formed thereon and a shaft inserted through the hub, wherein the first shell defines two slots each for receiving the shaft of one of the two bending elements.

12. The stapler according to claim 4 wherein each of the bending elements comprises a hub formed thereon and a shaft inserted through the hub, wherein the second shell defines two slots each for receiving the shaft of one of the two bending elements.

13. The stapler according to claim 12 wherein each of the two movable cutting elements comprises a shank formed thereon, wherein a blade is formed on the shank, wherein the hub defines a groove receiving the shank.

14. The stapler according to claim 1 wherein each of the two bending elements comprises a first arm for bending one of the first and second legs of each staple and a second arm formed next to the hub for contact with the pusher.

15. The stapler according to claim 14 wherein the first arm is separated from the second arm by an angle.

16. The stapler according to claim 14 wherein the first arm defines a groove for receiving one of the first and second legs of each staple.

17. The stapler according to claim 1 wherein the two movable cutting elements are moved towards the stationary cutting element in a rectilinear path.

18. The stapler according to claim 16 wherein each of the two wedges comprises a pair of wedges.

19. The stapler according to claim 18 wherein each of the two wedges comprises a slope, wherein each of the two movable cutting elements comprises a slope for sliding on the slopes of one of the two wedges.

* * * * *